US006217401B1

(12) United States Patent
Peterson

(10) Patent No.: US 6,217,401 B1
(45) Date of Patent: Apr. 17, 2001

(54) INFLATABLE TOWABLE VEHICLE

(75) Inventor: Leroy L. Peterson, Omaha, NE (US)

(73) Assignee: Sportsstuff, Inc., Omaha, NE (US)

( * ) Notice: Subject to any disclaimer, the term of this patent is extended or adjusted under 35 U.S.C. 154(b) by 0 days.

(21) Appl. No.: 09/570,964

(22) Filed: May 15, 2000

(51) Int. Cl.[7] ..... B63B 1/00
(52) U.S. Cl. ..... 441/65
(58) Field of Search ..... 441/65–67, 129–131, 441/136; 114/345

(56) References Cited

U.S. PATENT DOCUMENTS 4,635,581 * 1/1987 Sceurer ..... 441/67
5,167,554 * 12/1992 Tager et al. ..... 441/131

* cited by examiner

*Primary Examiner*—Jesus D. Sotelo
(74) *Attorney, Agent, or Firm*—Henderson & Sturm LLP

(57) ABSTRACT

An inflatable towable vehicle including a inflatable body member having an interior wall defining a central cavity, a flexible body shell disposed to surround the body member and having an end opening at the lower part of the interior wall, and a seat sized to matingly fit within the central cavity. The exterior wall of the seat engages the body shell over the interior wall of the body member and pulls the body shell taut as the seat is inserted into the cavity. The seat includes an inflatable bladder with an outside diameter slightly larger than the inside diameter of the cavity which slightly deforms the body member to provide a seal between the body member and the seat. Thus, no zipper closures are required to secure the body shell to the body member.

9 Claims, 1 Drawing Sheet

INFLATABLE TOWABLE VEHICLE

BACKGROUND OF THE INVENTION

1. Field of the Invention

The present invention relates to the field of recreational vehicles, and more particularly to an inflatable towable vehicle.

2. Description of Related Art

The prior art is replete with myriad and diverse inflatable vehicles. These vehicles typically included an inflated body member with a protective fabric shell which is secured to the body member by a zipper closure. These zippers add to the cost of manufacture and are subject to failure.

While all of the aforementioned prior art constructions are more than adequate for the basic purpose and function for which they have been specifically designed, they are uniformly deficient with respect to their failure to provide a simple, efficient, and practical inflatable towable vehicle having the shell secured to the body member without the use of zippers.

As a consequence of the foregoing situation, there has existed a longstanding need for a new and improved inflatable towable vehicle, and the provision of such a construction is a stated objective of the present invention.

BRIEF SUMMARY OF THE INVENTION

Briefly stated, the present invention provides an inflatable towable vehicle including an inflatable body member having an interior wall defining a central cavity, a flexible body shell disposed to surround the body member and having an end opening at the lower part of the interior wall, and a seat sized to matingly fit within the central cavity. The exterior wall of the seat engages the body shell over the interior wall of the body member and pulls the body shell taut as the seat is inserted into the cavity. The seat includes an inflatable bladder with an outside diameter slightly larger than the inside diameter of the cavity which slightly deforms the body member to provide a seal between the body member and the seat. Thus, no zipper closures are required to secure the body shell to the body member.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
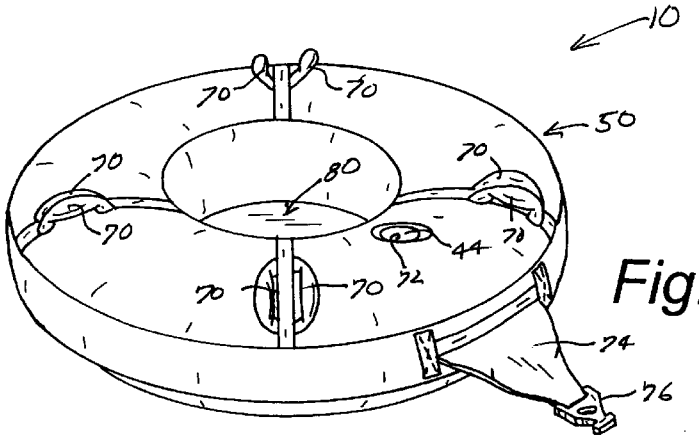
FIG. 1 is a perspective view of the inflatable towable vehicle of the present invention.
Figure 2:
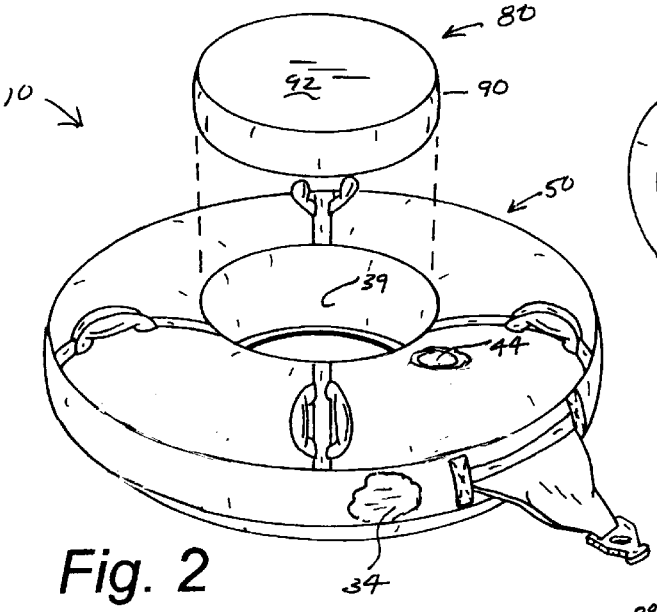
FIG. 2 is an exploded perspective view showing the seat positioned to be inserted into the central cavity of the body member.
Figure 3:
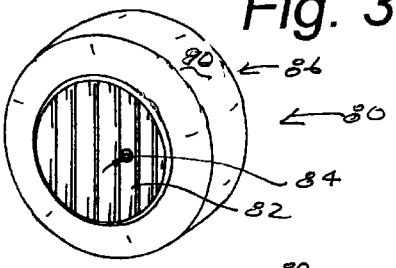
FIG. 3 is a bottom perspective view of the seat with a seat shell secured thereto.

As can be seen by reference to the drawings, and in particular to FIG. 1, the inflatable towable vehicle that forms the basis of the present invention is designated generally by the reference number 10. The towable vehicle 10 includes an inflatable body member 20, a flexible body shell 50, and a seat 80.

Figure 5:
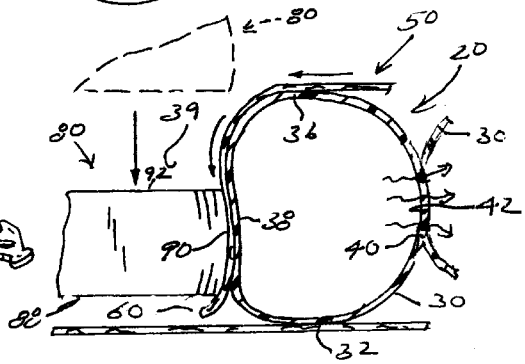
FIG. 5 is a partial sectional view similar to FIG. 4, but showing the body member being slightly deformed by the insertion of the seat to provide a seal between the body member and the seat.
Figure 4:
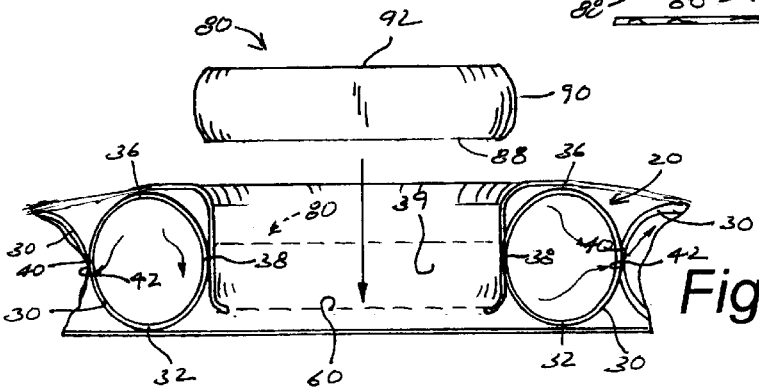
FIG. 4 is a sectional view with a full line showing seat positioned to be inserted into the cavity and a dashed line showing of the seat in the cavity pulling the body shell taut.

As best shown in FIGS. 4 and 5, the inflatable body member 20 includes a number of adjacent concentric rings 30. Each pair of adjacent rings 30 has a common wall 40 with openings 42 formed therethrough to provide fluid communication between the rings 30. An air inflation valve 44 is carried on one of the rings 30, and all rings 30 are inflated by pressurized air which enters the valve 44 and flows through the openings 42 in the common wall 40. In the preferred embodiment, the rings 30 form a body member 20 having a bottom 32 and exterior wall 34, a top 36, and an interior wall 38 that defines a centrally located cavity 39. The rings 30 have progressively decreasing cross sectional diameters from the interior wall 38 to the exterior wall 34 that forms an outwardly tapered profile of the body member 20.

The flexible body shell 50 covers the body member 20 and has an end opening 60 that is disposed at the lower part of the interior wall 38. The body shell 50 may be constructed of any suitable material such as nylon fabric. The portion of the shell 50 overlying the tops 36 of the rings 30 carries a number of handles 70, and an opening 72 that provides access to the inflation valve 44. A portion of the shell 50 overlying the exterior wall 34 carries a towing tongue 74 and a tow line connector 76.

The seat 80 includes an inflatable bladder 82 with an inflation valve 84. In the preferred embodiment, the inflatable bladder 82 is covered by a seat shell 86 made of material similar to that of the body shell 50. The seat 80 has a bottom 88, an exterior wall 90, and a top 92. The seat 80 is sized so that the outside diameter of the exterior wall 90 is slightly larger than the inside diameter of the inside diameter of the cavity 39.

When the seat 80 is inserted into the cavity 39, it acts to pull the body shell 50 taut around the body member 20 and slightly deforms the body member 20 to form a seal as shown in FIG. 5. This construction allows the shell 50 to be secured to the body member 20 without the use of zippers or other closures.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. An inflatable towable vehicle, comprising:

an inflatable body member including a bottom, an exterior wall, a top, and an interior wall defining a centrally located cavity having an inside diameter;

a flexible body shell disposed to cover the bottom, the exterior wall, the top and the interior wall of the body member, the shell having an end opening loosely disposed at a lower part of the interior wall;

a seat including a bottom, an exterior wall and a top, the seat being sized to matingly fit within the cavity of the body member such that the exterior wall of the seat engages the body shell disposed over the interior wall of the body member above the end opening and pulls the body shell taut as the seat is inserted into the cavity.

2. The vehicle of claim 1 wherein the seat includes an inflatable bladder.

3. The vehicle of claim 2 wherein the bladder is covered by a flexible seat shell.

4. The vehicle of claim 3 wherein the flexible seat shell is made of nylon fabric.

5. The vehicle of claim 1 wherein the flexible body shell is made of nylon fabric.

6. The vehicle of claim 1 wherein the body member includes a plurality of adjacent concentric rings disposed in fluid communication with an inflation valve.

7. The vehicle of claim 6 wherein each pair of adjacent rings include a common wall having openings therein thereby providing fluid communication between the adjacent rings.

8. The vehicle of claim 6 wherein the concentric rings form an outwardly tapered body member.

9. The vehicle of claim 1 wherein the seat has an outside diameter larger than the inside diameter of the cavity of the body member such that the interior wall of the body member is deformed to provide a seal between the body member and the seat as the seat is inserted into the cavity.

* * * * *